United States Patent [19]

Uyeda et al.

[11] Patent Number: 4,628,715

[45] Date of Patent: Dec. 16, 1986

[54] TUMBLER WHEEL ASSEMBLY SHIELD FOR COMBINATION LOCKS

[75] Inventors: Tim M. Uyeda, S. San Gabriel; Klaus W. Gartner, Palos Verdes Estates, both of Calif.

[73] Assignee: La Gard, Inc., Torrance, Calif.

[21] Appl. No.: 707,441

[22] Filed: Mar. 1, 1985

[51] Int. Cl.[4] ..... E05B 37/08

[52] U.S. Cl. ..... 70/333 R; 70/416; 70/417

[58] Field of Search ..... 70/333 R, 1.5, 1.7, 70/416, 417, 333 A

[56] References Cited

U.S. PATENT DOCUMENTS 3,098,376 7/1963 Miller ..... 70/333 R
3,981,167 9/1967 Phillips .
3,991,596 11/1976 Gartner .
4,142,388 3/1979 Phillips et al. .
4,493,199 1/1985 Uyeda ..... 70/333 R

OTHER PUBLICATIONS

Ser. No. 676,628, Uyeda, filed 11-30-84.

*Primary Examiner*—Robert L. Wolfe
*Attorney, Agent, or Firm*—Poms, Smith, Lande & Rose

[57] ABSTRACT

An improved device for preventing unauthorized opening of a combination lock of the type having a plurality of tumbler wheels in conjunction with a fence-lever-actuated bolt in which a tumbler wheel assembly shield having an opening to avoid a rearward expulsion of the dial shaft provides a barrier to unauthorized rearward or radial manipulation of the tumbler wheel assemblies by use of fishing hooks inserted and manipulated from the front of the lock.

8 Claims, 12 Drawing Figures

Fig. 1.
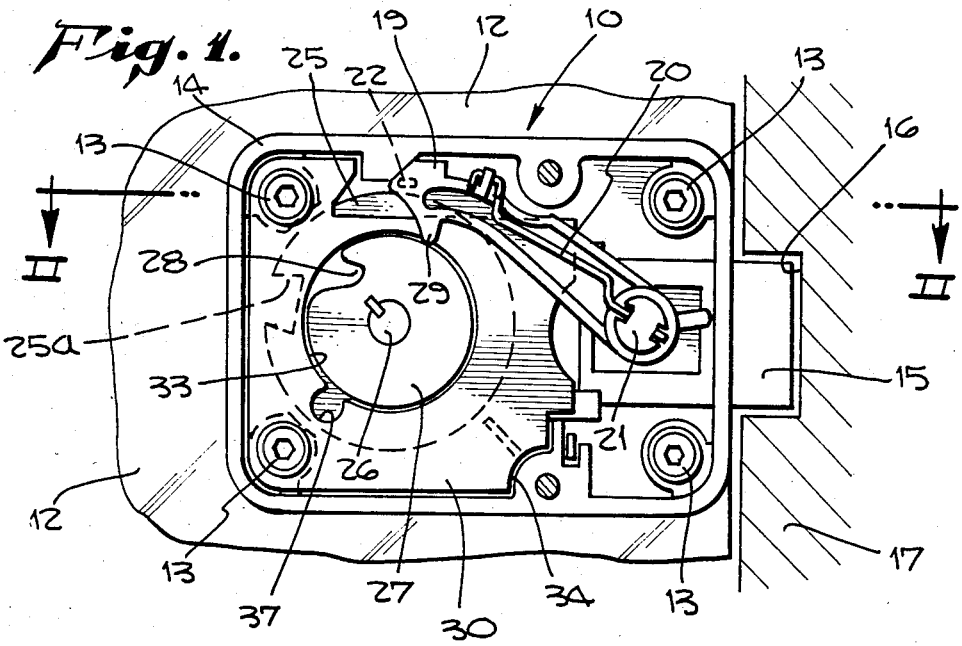
Fig. 2.
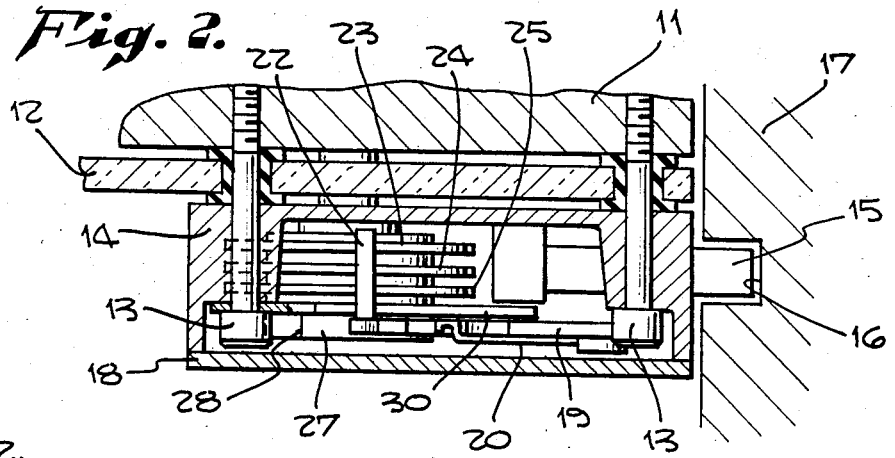
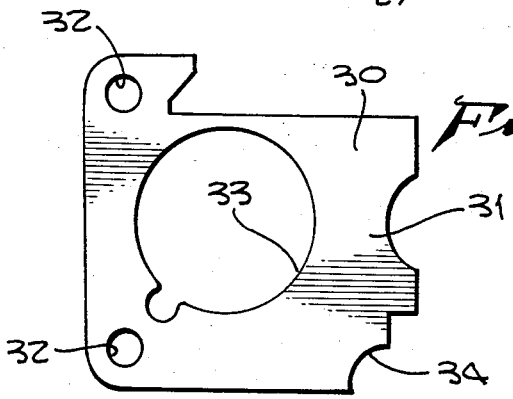
Fig. 3.
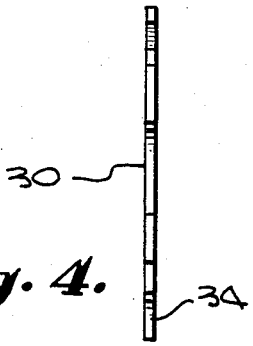
Fig. 4.

Fig. 6.
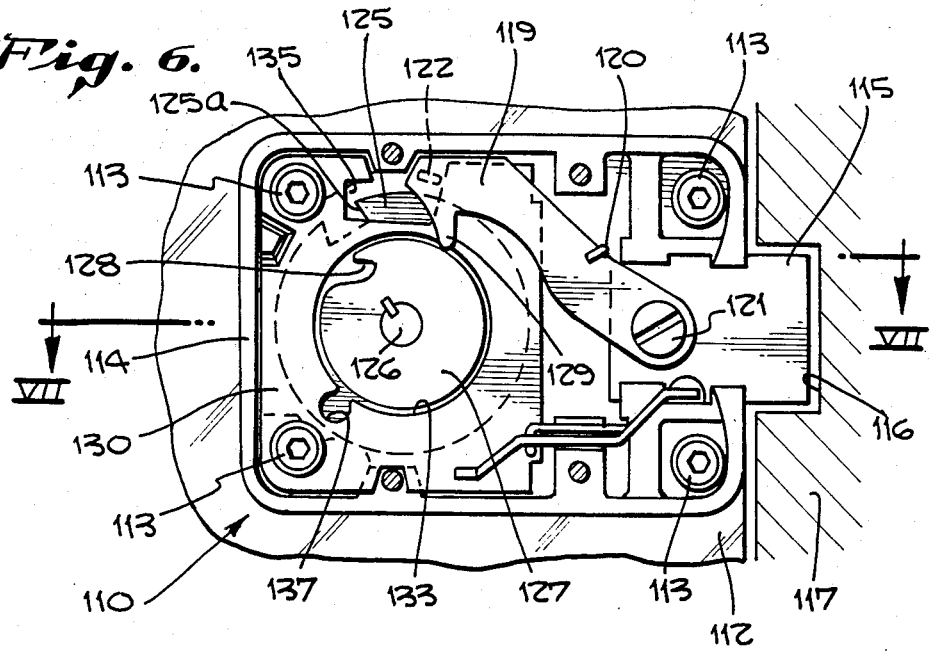
Fig. 7.
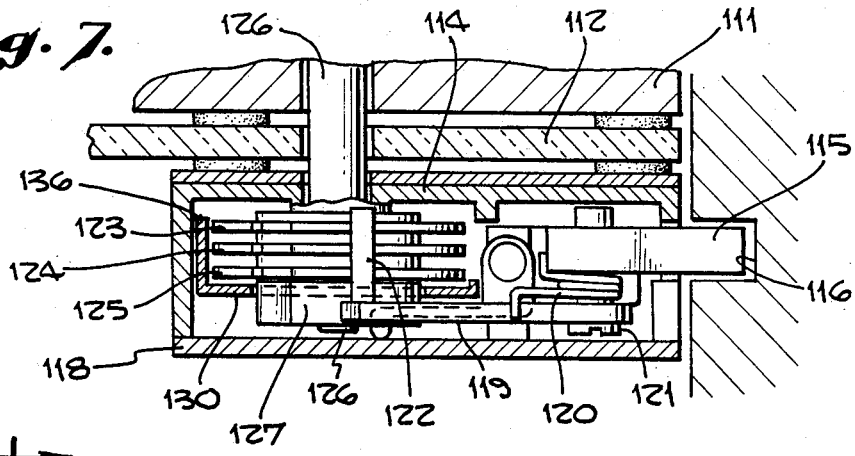
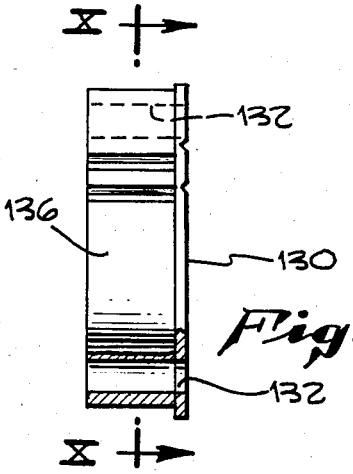
Fig. 9.
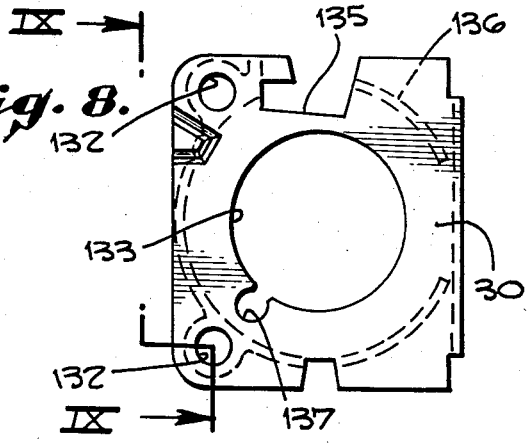
Fig. 8.

TUMBLER WHEEL ASSEMBLY SHIELD FOR COMBINATION LOCKS

BACKGROUND OF THE INVENTION

This invention relates, in general, to combination locks, and in particular, to an improvement consisting of a device for preventing unauthorized opening of the lock through illicit internal manipulation of the lock components.

Combination locks of the type to which this invention pertains commonly employ a plurality of gated tumbler wheel assemblies axially-disposed on the dial shaft of the lock. Exemplary of these tumbler wheel assemblies is that disclosed in U.S. Pat. No. 4,142,388 to Phillips, et al. Normally, these tumbler wheels are accesses for manipulation by the user by means of the dial shaft, which passes through the housing of the lock and is typically provided with a numbered dial wheel affixed to its outer extremity. By suitable manipulation of the dial wheel in a series of predetermined rotations, the user will cause the gates located in each of the tumbler wheel assemblies to arrive in an aligned position. It is only upon the occurrence of this circumstance that an arm or fence will fit into the gate, and, depending on the construction of the lock, cause a latch to open, or in some cases, upon further manipulation of the dial or separate mechanism, the lock bolt to be drawn.

In the latter type of lock, it is not uncommon for the lock to include a fence lever which is pivotally-attached to the bolt and having a cam-following nose part which rides upon a cam wheel mounted on the dial shaft. The fence lever is biased towards the cam wheel, which also has a gate in it, and, when the predetermined combination of numbers is dialed on the dial wheel, the gates of the tumbler wheel assemblies align, permitting the fence on the lever to fall into their gates which, in turn, permits the nose part of the lever to engage the cam wheel gate, and, upon further rotation of the dial shaft by the operator, the fence lever is caused to translate and withdraw the bolt.

It is common in these combination locks for the nose portion of the fence lever normally to ride on the outer periphery of the cam wheel so that the fence member associated with the fence lever will not ride upon the tumbler wheels of the lock mechanism. Typical of such locks is that shown in U.S. Pat. No. 4,142,388. It is desirable to avoid having the fence lever ride upon the tumbler wheel because experience has taught that persons skilled in illicit lock manipulation can develop a "feel" for the position of the tumbler wheel assemblies from vibrations sent through the combination dial shaft such that, given sufficient time and access to the lock, these persons may gain unauthorized entry into the area these locks are intended to protect.

Unfortunately, experience has also taught that the engagement between the nose portion of the fence lever and the gate of the cam wheel can also permit a skilled person to determine where the cam wheel gate is by "feel" and then by manipulating the lock parts in a predetermined manner, also bring the fence member in contact with the edges of the gates of the wheel assemblies while the lever nose is positioned in the cam wheel gate.

Various mechanisms have been utilized to overcome the contact or "feel" of the fence lever or the nose piece riding on the rotating lock portion which is typically accomplished by retaining the fence lever in a position away from the rotating components until such point in the manipulation of the lock as it becomes desirable to have the fence lever engage within the gate of the tumbler wheels on the cam wheel. Such devices are disclosed in U.S. Pat. No. 3,991,596 and a co-pending application, Ser. No. 676,628 filed Nov. 30, 1984.

Unfortunately, experience has taught that persons confronted with such locks and possessed of a strong desire to achieve access to the contents of areas protected by these locks, but lacking the wherewithall to do so, will resort to extraordinary unauthorized access means. For example, it has been demonstrated that, given sufficient access to the lock, the combination dial can be removed from the dial shaft by the application of sufficient force, such as that applied with a sledge hammer. With the dial shaft thus exposed, a blow can then be struck to the shaft in the direction of its axis which, of sufficient magnitude, will expel the dial shaft through the rear of the lock's housing. The unauthorized manipulator can then, by means of insertion of one or more hook-shaped fishing wires through the dial shaft bore, manipulate the gates of the tumbler wheels into alignment and/or activate the fence lever.

Similarly, it has been demonstrated that an unauthorized lock manipulator can, by means of drilling into the front of the lock into the region of the housing immediately outside the circumference of the tumbler wheel assemblies, insert one or more hook-shaped "fishing" wires into the interior of the lock and, by suitable manipulation of the circumference of the tumbler wheel assemblies, gain illicit access.

SUMMARY OF THE INVENTION

It is, therefore, the primary object of the present invention to disclose and provide a simple, yet reliable and effective device for preventing unauthorized opening of a combination lock by means of internal manipulation of the lock components by use of wires or tools inserted through the front of the lock.

It is a further object of the present invention to provide such a device that is easy and inexpensive to manufacture.

It is yet a further object of the present invention to provide such a device that is easily incorporated into existing locks at their installation site without the need for expensive lock replacement or re-working of the lock.

Generally stated, the present invention includes a tumbler wheel assembly shield which prevents access to the tumbler wheel surfaces from the rear of the lock and/or along their radial surfaces, which is retained in place within the lock even if the dial shaft is driven forcefully through the rear of the lock by a blow from the front.

More specifically, the present invention includes a simple plate made of a relatively-rigid material, such as metal, so configured as to fit within the housing in a plane between the fence lever and the tumbler wheel assemblies and parallel to the tumbler wheel assemblies, and so further configured as to avoid the existing components within the lock while yet providing a barrier to the entry from a rearward or radial direction of manipulation tools into the region of the outer gate ring of the tumbler wheels.

The present invention further includes an opening in the plate having a diameter only slightly larger than that of the cam wheel and oriented opposite to, and in line with, the cam wheel, such that, even if the cam wheel is forcefully expelled from the rear of the lock along with the dial shaft, the shield will remain intact within the lock, and if the cam wheel is not expelled, will work in combination with the plate to provide additional barrier area to a rearward entry of manipulating tools.

In a preferred exemplary embodiment of the present invention, the plate includes holes for fasteners so disposed on the plate that the same fasteners which are used to mount the combination lock to its operational surface can be utilized to mount the shield.

In another embodiment of the present invention, the flat plate is provided with a cylindrical flange projecting orthogonally from the front face of the shield into the region of the lock housing which surrounds the radial surfaces of the tumbler wheel assemblies such that a barrier is erected to the radial surface of the tumbler wheel gate rings whereby, even if access were gained by manipulating tools into this region, a radial manipulation of the barrier wheels is prevented.

A more complete understanding of the improvement afforded by the present invention will become evident to those skilled in the art from a consideration of the following detailed description of two preferred exemplary embodiments thereof and reference to the included drawings, a brief description of which follows.

BRIEF DESCRIPTION OF THE DRAWINGS

FIG. 1 is a plan view of the rear of a typical fence-lever-actuated combination lock, having a plurality of tumbler wheel assemblies as described herein.

FIG. 2 is a section view of the lock taken in FIG. 1 down through the lock, along plane II—II.

FIG. 3 is a plan view of one preferred exemplary embodiment of the present invention, a tumbler wheel assembly shield.

FIG. 4 is a side view of the exemplary embodiment of the present invention shown in FIG. 3.

FIG. 6 is a plan view of a similar type of combination lock with the cover removed and showing a second, preferred embodiment of the present invention in place.

FIG. 7 is a sectional view down through the lock shown in FIG. 6 and taken along the plane VII—VII.

FIG. 8 is a plan view of the second preferred embodiment of the present invention.

FIG. 9 is a side view of the second preferred embodiment shown in FIG. 8.

Figure 5:
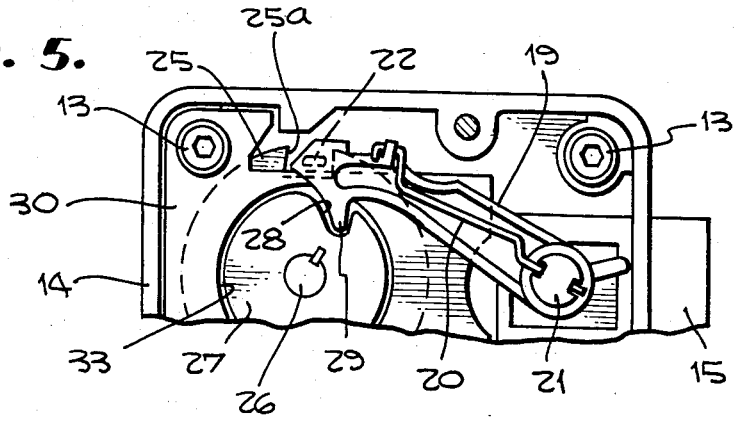
FIG. 5 is a partial plan view of the combination lock shown in FIG. 1 in which the fence is in the engaged position within the aligned gates of the tumbler wheel assemblies and the nose part of the fence lever is engaged within the gate of the cam wheel, showing the barrier afforded by the shield to rearward entry to the gated tumbler wheels, shown by dashed lines.
Figure 11:
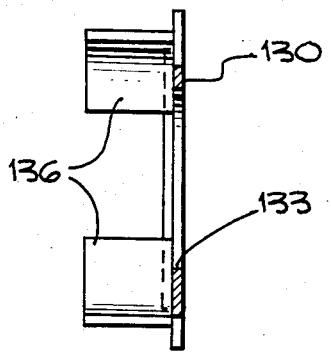
FIG. 11 is a section view taken through the second preferred embodiment of the present invention, shown in FIG. 10 taken at plane XI—XI.

DETAILED DESCRIPTION OF TWO EXEMPLARY PREFERRED EMBODIMENTS OF THE PRESENT INVENTION

Referring initially to FIGS. 1, 2 and 3, one exemplary embodiment of the present invention, a tumbler wheel assembly shield, is illustrated. The exemplary combination lock 10 is typically mounted to the interior surface of a safe door 11, with an inter-disposed guard plate 12 by means of mounting screws 13 in a known fashion. The guard plate and lock mounting means may be provided as in the disclosure of U.S. Patent Application Ser. No. 508,119, filed June 27, 1983, entitled "Protective Lock Mounting Plate for Safe Door Locks" or, alternatively, as disclosed in application for U.S. Letters Patent Ser. No. 649,666, filed Sept. 12, 1984, entitled "Lock Protecting Device for High Security Safes".

The exemplary lock includes a housing 14 and a drawable bolt 15 which is adapted to be received within a receptacle 16 formed in the safe wall 17 in a conventional manner. The generally box-shaped housing 14 is provided with a cover 18 which is held in place with screws. The exemplary lock further includes a fence lever 19 typically biased by means of a fence lever spring 20 about a pivotal attachment 21 upon the bolt 15. The fence lever 19 is provided with a fence 22 which prevents the fence lever 19 from pivoting about the pin 21 until each of the gates 25*a* in the tumbler wheel assemblies 23, 24 and 25 are manipulated into proper alignment by the lock's operator. This is accomplished by a rotational manipulation of the dial shaft 26 by the operator.

Typical within the exemplary locks is the presence of a cam wheel 27 which is pinned to the dial shaft 26 at its inner extremity. The cam wheel 27 also contains a gate 28 which is designed to receive a nose part 29 on the fence lever 19 when the cam wheel 27 is properly rotationally-oriented.

Thus, in the operation of the examplary lock, the bolt 15 remains in the receptacle 16 of the safe wall 17 until, by suitable manipulation of the dial shaft 26, the gates 25*a* of the tumbler wheel assemblies 23, 24 and 25 and the gate 28 of the cam wheel 27 are appropriately oriented by the operator by dialing the proper combination, at which point, the fence lever spring 20 will urge the fence lever 19 such that the fence 22 will fall within the aligned gates 25*a* and the nose part of the lever 29 will engage in the gate 28 of the cam wheel 27 and, upon further rotation of the dial shaft 26, will pull bolt 15 out of the safe wall receptacle 16 to cause unlocking of the lock.

It has been demonstrated heretofore that unauthorized persons, in an effort to gain entry to the contents of the area protected by the combination lock, can remove the dial of the lock by means of a sharp blow to the dial shaft 26 from the front of the lock and then drive the shaft 26 through the safe wall 11 and expel it rearward through the cover 18 of the lock, whereby illicit access to the interior of the lock is gained through the hole formerly occupied by the shaft 26. The tumbler wheel assemblies 23, 24 and 25 can then be manipulated from the rear direction by means of one or more hook-shaped wires inserted through the hole from the front of the lock, whereby the fence lever 19 can be engaged to withdraw the bolt 15 and unlock the lock.

In yet another scenario, it has been demonstrated that, by drilling a small hole through the front of the lock 10 and into the region between the housing wall 14 and the outside radial surface of the tumbler wheel assemblies 23, 24 and 25, an unauthorized lock manipulator can insert one or more hook-shaped wires into the interior of the lock and by skillful manipulation thereof, cause the gate 25a of the tumbler wheel assemblies 23, 24 and 25 to come into alignment, whereby the lock may be opened and unauthorized access to the area protected by the lock may be had.

As stated hereinbefore, it is a primary object of the present invention to disclose a simple, inexpensive, yet reliable means for preventing this unauthorized manipulation of the lock's components by unauthorized persons which is easy and inexpensive to fabricate and which can be incorporated into existing locks without replacement or significant redesign.

As is particularly contemplated within the present invention, the first form of an improved device for preventing unauthorized opening of a combination lock by internal, rearward manipulation of the lock components in the form of a tumbler wheel assembly shield 30 is illustrated generally in the attached drawings which lies in a plane between the cam wheel 27 and the fence lever 19 when it is mounted within the lock 10 as is illustrated in FIG. 1. The shield 30 includes two mounting holes 32 through which fasteners may pass into the housing 14 for retaining the shield 30 within the lock 10. Additionally, the shield 30 is provided with an opening 33 which is slightly larger in diameter than the cam wheel 27 and a small opening 37 through which a combination-setting key may be inserted through the shield 30 and into the tumbler wheel assemblies, 23, 24 and 25.

The shield 30 must be sufficiently thin to permit it to be installed within the lock 10 without interfering with the movement of any of the lock components and sufficiently rigid to resist the forces of the end of a piece of bent wire, or similar tool, inserted from the front of the lock through the hole of the dial shaft 26.

As is evident from an inspection of FIGS. 3 and 4, the shield 30 may be simply machined or die-stamped from a piece of sheet-stock material, such as brass, aluminum or steel sheet, or may easily be fabricated by a molding process in either a metallic or plastic material. These materials and methods of manufacture are mentioned only in passing and without limitation as to other methods and materials of fabrication which are obvious to those skilled in the art.

FIGS. 1 and 2 illustrate the first preferred embodiment of the present invention as it is mounted within the lock 10. In operation, the shield 30 is retained within the housing 14 by means of a pair of screws 13, which screws also serve to mount the lock 10 to the safe wall 11. The shield 30 is mounted in the plane lying between the fence lever 19 and the first 25 of the series of tumbler wheel assemblies 23, 24 and 25. It may be seen in FIG. 1 that, when the shield 30 is in the installed position, the gated outer wheel of the tumbler wheel assemblies 23, 24 and 25 are obscured from the rear by the face 31 of the shield 30, whereas the fence 22 of the fence lever 19 may still traverse its entire line of travel without impediment. The cam wheel opening 33 in the shield 30 is positioned directly opposite, and aligned with, the diameter of the cam wheel 27 such that, in the event the dial shaft 26 is forcefully expelled from the rear of the lock, and even if the shaft 26 is accompanied by the cam wheel 27, these components will pass through the shield 30 and it will remain in place. Consequently, a hook-shaped fishing tool inserted from the front of the lock, through the hole formerly occupied by the shaft 26, will encounter the barrier of the shield 30 as it approaches the tumbler wheel assemblies 23, 24 and 25 from a rearward direction and the unauthorized manipulation of the wheels is circumvented.

FIG. 5 illustrates the exemplary embodiment of the present invention shown in FIG. 3 as it relates to the operation of the fence lever 19. In this illustration, the shield 30 is shown to lie between the plane of the fence lever 19 and the plane of the first 25 of the tumbler wheel assemblies 23, 24 and 25 and is so configured as to avoid the fence 22 of the fence lever 29 and the extremities of the bolt 15 and pivot pin 21 at all points of their travel during the unlocking of the box.

FIG. 8 discloses a second preferred embodiment of the present invention in which the plate of the tumbler wheel assembly shield 130 is additionally provided with a flange 136 which projects orthogonally from the rear face of the shield 130 in a direction toward the tumbler wheel assemblies 123, 124 and 125. An examination of FIGS. 8–11 reveal this flange to be substantially cylindrical in shape, having an internal diameter slightly larger than that of the tumbler wheel assemblies 123–125 and a depth slightly greater than that of the combined depth of the tumbler wheel assemblies 123–125. The thickness of the flange 136 is adjusted to permit it to pass into the region between the wall of the housing 114 and the tumbler wheel assemblies 123–125. As in the first illustrated preferred embodiment, the shield 131 contains cutouts in its periphery 135 and in the flange 136 to avoid components within the lock and to permit a fence 122 of the fence lever 119 to traverse its entire line of travel without impediment.

FIGS. 6 and 7 illustrate the second form of the preferred embodiment of the present invention as it is retained within the type of combination lock that is the subject of this disclosure. It may be seen in FIG. 7 that the flange 136 of the shield 130 encapsulates the tumber wheel assemblies 123–125 in a rigid barrier to access of the tumbler wheels from the radial direction.

The shield 130 may be provided with mounting bosses as an extension of the flange 136 having mounting holes 132 incorporated therethrough, such that the shield 130 may be mounted within the lock 110 and retained at the appropriate height by means of fasteners 113 into the housing 114, and more particularly, as illustrated in the present figures, by the same mounting screws 113 which retain the housing 114 to the safe door 111.

Figure 10:
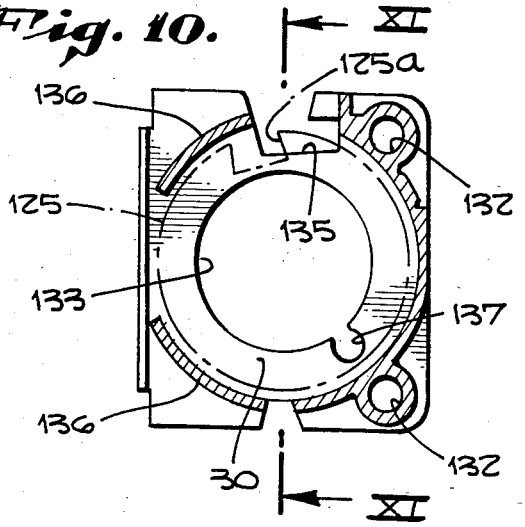
FIG. 10 is a front plan view of the second preferred embodiment of the present invention shown in FIG. 8.
Figure 12:
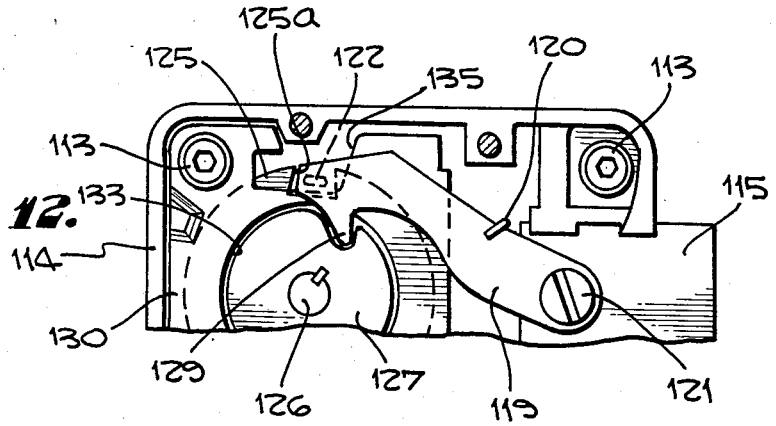
FIG. 12 is a partial plan view of the combination lock shown in FIG. 6 with the fence of the fence lever engaged within the aligned gates of the tumbler wheel assemblies and the hose part of the fence lever engaged within the gate of the cam wheel.

FIG. 12 illustrates the second form of preferred embodiment of the present invention in place within the lock 110 and demonstrates how the travel of the fence 122 and the lever arm 129 during its range of travel in the unlocking motion of the lock 110 is avoided. The barrier to the rearward entry of a spurious fishing tool to the tumbler wheel assemlies 123–125 is illustrated in FIG. 10 where the outside periphery of the tumbler wheel assemblies 123–125 is illustrated as a phantom line.

Similarly, as will be revealed to those skilled in the art by a review of FIGS. 6–12, the second form of the preferred embodiment of the present invention provides an additional protection against unauthorized manipulation of the lock components. Thus, one or more hook-shaped wires or tools, if introduced into the interior of the lock by means of holes drilled from the front of the lock into the spaces between the interior walls of the housing 114 and the tumbler wheel assemblies 123–125 will encounter a rigid barrier to manipulation of the tumbler wheel assemblies 123–125 by contact with their radial outer surfaces and the unauthorized opening of the lock by this route is circumvented. As contemplated, this second form of the preferred embodiment of the present invention can be simply and inexpensively fabricated by a variety of methods and from a variety of materials. As more particularly contemplated with respect to the present invention, the shield 130 is fabricated by a precision die casting method from an alloy of zinc. However, as is in the case of the first preferred embodiment, a variety of additional fabrication methods and materials will quickly spring to the minds of those skilled in the practice of the art.

As is now apparent, the tumbler wheel assembly shield device of the present invention is very simple in its construction, implementation and mode of operation, and is easily adapted to incorporation within either new locks or existing locks within the field without the necessity of replacement of the locks or expensive reworking. As such, it provides a simple, yet reliable, improvement to the art for preventing unauthorized opening of combination locks of the type that is the subject of the present invention through the internal manipulation of the lock components.

Having thus described two preferred exemplary embodiments of the tumbler wheel assembly shield, it should be noted by those skilled in the art that various modifications, adaptations and equivalent embodiments may be made within the spirit and scope of the present invention which is defined and limited only by the following claims.

We claim:

1. A combination lock security enhancing device for impeding unauthorized opening of a combination lock of the type having a lock housing, a plurality of tumbler wheels located within the housing and being rotatable by a lock dial associated spindle extending into the housing to cooperate with the tumbler wheels, and a fence lever for operating an associated bolt when the correct dialing of the lock combination aligns gates provided in the tumbler wheels with the fence lever, said device comprising the provision of: tumbler wheel assembly shielding means for covering a portion at least of the tumbler wheels in a location within said lock housing spaced rearwardly therein relative to said dial spindle and aperture means provided in said tumbler wheel assembly shielding means for facilitating passage of said spindle through said shielding means without disrupting its location within said lock housing in the event of an unauthorized effort to defeat the lock by the forcing of the spindle rearwardly out of the housing, wherein said tumbler wheel assembly shielding means further comprises:

a generally flat plate portion positioned generally parallel to and spaced from a rearward most tumbler wheel of said plurality of tumbler wheels and flange means extending from said plate portion generally around portions at least of said tumbler wheels to provide a shielding of both rearward and lateral portions of said plurality of tumbler wheels.

2. A combination lock security enhancing device for impeding unauthorized opening of a combination lock of the type having a lock housing, a plurality of tumbler wheels located within the housing and being rotatable by a lock dial associated spindle extending into the housing to cooperate with the tumbler wheels, and a fence lever for operating an associated bolt when the correct dialing of the lock combination aligns gates provided in the tumber wheels with the fence lever, said device comprising the provision of a tumbler wheel assembly shielding means for covering a portion at least of the tumbler wheels in a location within said lock housing spaced rearwardly therein relative to said dial spindle, and further comprising the provision of:

(1) a flat plate retained within the housing, located between the fence lever and the cam wheel and parallel to the cam wheel, which occupies at least substantially all of a zone, defined by the orthogonal projection of the tumbler wheel assemblies onto the plate, except for a region in the zone defined as the area occupied by the fence during its travel, and further having at least one opening in the zone defined by the projection of the cam wheel onto the plate which has an area sufficiently large to pass the cam wheel therethrough; and (2) means for retaining the plate within the housing such that the cam wheel opening is opposed to, and aligned with, the cam wheel.

3. The device as recited in claim 2 wherein the plate is further characterized by having at least one additional opening for a fastener.

4. The device as recited in claim 3 wherein the means for retaining the plate comprises at least one fastener passing through the additional fastener opening.

5. A device as recited in claim 2 further comprising a substantially-circular flange extending orthogonally from the plate towards the tumbler wheel assemblies to a depth at least equal to the depth of the tumbler wheel assemblies, the flange having an internal diameter slighly larger than the diameter of the tumbler wheel assemblies and having a cutout sufficient to clear the fence.

6. The device as recited in claim 5 further comprising at least one mounting boss extending orthogonally from the plate towards the housing and having a height equal to the mounting height of the plate.

7. The device as recited in claim 6 wherein the mounting boss contains a hole through it for a fastener.

8. The device as recited in claim 7 wherein the means for retaining the plate in the housing comprises at least one fastener passing through the fastener hole in the mounting boss.

* * * * *